US005820361A

United States Patent [19]

Lavigne et al.

[11] Patent Number: 5,820,361

[45] Date of Patent: Oct. 13, 1998

[54] HEAT EMITTER

[75] Inventors: Daniel M. Lavigne, Bierges; Jean H. Goovaerts, Rixensart, both of Belgium

[73] Assignee: Innovative Drying Systems, Bousval, Belgium

[21] Appl. No.: 892,228

[22] Filed: Jul. 14, 1997

[51] Int. Cl.[6] ..... F23D 14/14

[52] U.S. Cl. ..... 431/329; 126/92 AC

[58] Field of Search ..... 126/92 R, 92 AC, 126/92 B, 92 A; 431/329, 328, 326

[56] References Cited

U.S. PATENT DOCUMENTS 3,084,736 4/1963 Mentel ..... 431/329
3,852,025 12/1974 Placek ..... 431/329
4,039,275 8/1977 McGettrick ..... 431/329
4,492,564 1/1985 Wolf ..... 126/92 AC
5,520,536 5/1996 Rodgers ..... 126/92 AC

*Primary Examiner*—James C. Yeung
*Attorney, Agent, or Firm*—Sughrue, Mion, Zinn, Macpeak & Seas, PLLC

[57] ABSTRACT

A heat emitter including: a back-body with a distributor for a fuel-oxygen containing gas mixture; an organ having a combustion surface; a frame connecting the back-body with the organ; a screen; at least a pair of flanges provided with a hole; and at least one sliding bar, the end parts of which are engaged in the holes of the flanges.

12 Claims, 4 Drawing Sheets

HEAT EMITTER

BACKGROUND OF THE INVENTION

Applicant developed in 1995 a heat emitter or radiant comprising:

a frame that connects a body equipped with a distributor for distributing a fuel/combustive mixture, to a component that has a combustion surface;

a grating;

lugs forming one piece with the body and which have one or more holes, and one or more longitudinal small bars each extending between a first free extremity and a second free extremity, the first free extremity having a transverse section adapted for being engaged in a hole of the first lug, whereas the second free extremity has a transverse section adapted for being engaged in a hole of a second lug, each of the aforesaid small bars or the small bar, whose free extremities are engaged in the lug holes, serving as a support for an edge of the grating, in such a way as to attach the grating in relation to the aforesaid frame, the aforesaid lug holes and the free extremities of the small bars being adapted in order to enable a relative movement of the small bar or bars in relation to the aforesaid lugs.

Such a radiant is described in the unpublished Belgian application 09501070 of 22 Dec. 1995.

During tests at high temperatures this radiant however exhibited a risk of the grating falling, such fall then necessitating stopping the drying installation.

SUMMARY OF THE INVENTION

This invention aims at remedying this inconvenience.

The invention relates to a heat emitter or radiant comprising:

(a) a back-body provided with a distributor for distributing a fuel-oxygen containing gas mixture;

(b) an organ having a combustion surface;

(c) a frame receiving at least partly said organ and connecting said back-body with said organ (5);

(d) a screen;

(e) at least a pair of flanges facing each other attached to said back-body, each flange being provided with a hole, the hole of a first flange of said pair being distant of the hole of the second flange of said pair, and (f) at least one sliding bar extending longitudinally between a first end part and a second end part opposite to said first free end, said sliding bar having a length greater than the distance separating the hole of a first flange of said pair from the hole of the second flange of said pair, the said first end part and the said second end part having respectively a cross section adapted for being engaged in the hole of a first flange, and a cross section adapted for being engaged in the hole of a second flange.

In said heat emitter, when the said end parts of the bar are engaged in the holes of the said two flanges, the bar acts as support of an edge of the screen with respect to the frame. The said end parts of the bar have cross sections adapted for moving longitudinally the bar from a first position, in which the first end part and the second end part of the bar are respectively engaged in the hole of the first flange and in the hole of the second flange, to a second position in which the first end part is engaged in the hole of the first flange, while the second end part is not engaged in the hole of the second flange, and inversely.

The first end part has a cross section adapted with respect to the hole of the said first flange for pivoting the bar with respect to the first flange up to a position in which the bar is removable by pulling it out of the hole of said first flange, while, at least for one flange, the shape of the hole with respect to its central axis and the cross section of the end part of the bar to be engaged into said hole are adapted for limiting the rotation of the bar about said central axis, preferably for avoiding or preventing any rotation of the bar with respect to said central axis.

Advantageously, the hole is defined by a continuous edge comprising at least two different parts, at least one of said parts being straight, while the end part of the bar intended to be engaged in said hole has at least two faces, one of which is flat, whereby, when said end part of the bar is engaged in the hole, a flat face of said end part contacts a straight part of the edge of the hole while another face of said end part contacts at least partly another part of the edge of the hole.

According to an embodiment of the heat emitter of the invention, the frame comprises a first side, a second side opposite to the first side, third and fourth sides linking said first and second sides, said sides being provided with a substantially flat element having a first face directed towards the said organ at least partly engaged in the frame and a second face opposite to said first face and directed towards the screen in which the said first and second sides are adjacent respectively to a first flange and a second flange borne by the back-body, said first and second flanges facing each other and having two holes receiving the end part of two sliding bars, whereby a first sliding bar extends between a first hole of the first flange and a first hole of the second flange so as to support a first edge band of is the screen, while the second sliding bar extends between the second hole of the first flange and the second hole of the second flange so as to support a second edge band of the screen opposite to said first edge band. In said embodiment, the end parts of the first and second bars have cross sections adapted with respect to the holes of the flanges for moving longitudinally each of said bars from a first position, in which the first end part and the second part of the bar are respectively engaged in the hole of the first flange and in the hole of the second flange, to a second position in which the first end part is engaged in the hole of the first flange, while the second end part is not engaged in the hole of the second flange, and inversely. The first end parts of the first and second bars have respective cross sections adapted, with respect to the holes of the first flange in which said end parts are engaged, for pivoting each bar with respect to the first flange up to a position in which the bar is removable by pulling it out of the hole of said first flange. The second end parts of the first and second bars have respective cross sections adapted, with respect to the hole of a flange in which each second end part is engaged, for avoiding the rotation of the bar about its central axis.

Preferably, the screen comprises a central part linked by intermediary parts to the edge bands, the said edge bands extending in a plane which is parallel to the plane in which the central part extends.

According to a detail of the said embodiment, the screen comprises a central part linked by intermediary parts to the edge bands, the said edge bands extending in a plane which is parallel to the plane in which the central part extends, in which each intermediary part extends in a plane inclined with respect to the plane in which extends the central part, and in which each edge band is provided with an end part inclined with respect to the plane in which the edge band extends so as to define with an intermediary part a groove in which a bar extends. Preferably, each bar has a first planar face for contacting an edge band of the screen, a second planar face directed towards an intermediary part and a third planar face directed towards an end part.

For example, the screen comprises a central part linked by intermediary parts to the edge bands, the said edge bands extending in a plane which is parallel to the plane in which the central part extends, in which each intermediary part extends in a plane forming an angle from 110° to 120° with respect to the plane in which extends the central part, and in which each edge band is provided with an end part forming an angle from 80° to 120° with respect to the plane in which extends the edge band, so as to define with an intermediary part a groove in which a bar extends.

Possibly, each flange consists of two distinct pieces each having a hole, while the back-body is provided with abutments for avoiding any pivoting of said pieces when attached to the back-body.

Advantageously, each flange consists of a piece comprising a central plate bearing at one end a first ear with a hole and at the other hand a second ear with a hole, said central plate having, between its ends, at least one part with a cross section lower than the cross section of the plate near its ends.

The said flanges are preferably made of refractory stainless steel or of cast iron, advantageously refractory steel containing more than 14% Cr, in particular from 18 to 30% chrome, refractory steel containing more than 12% Ni, in particular from 18 to 40% nickel, refractory steel containing more than 14% Cr and more than 12% Ni.

By way of particular example, the steel is in steel which contains approximately 20% chrome and approximately 38% nickel.

In the heat emitter of the invention, the body bears the flanges or lugs. Indeed, the frame is subjected to very high temperature and almost cannot be cooled, so that the expansion of the frame is liable to be significant. Thus, were the lugs mounted directly onto the frame, these lugs would undergo real movements or expansion, but equally movements due to the expansion of the frame. Too significant movements of expansion can be the cause of the disengagement of an extremity of a small bar out of the lug hole, and therefore the cause of a fall of the grating.

Characteristics and details of the invention will ensue from the following detailed description in which reference is made to the drawings attached hereto.

DESCRIPTION OF PREFERRED EMBODIMENTS

Figure 1:
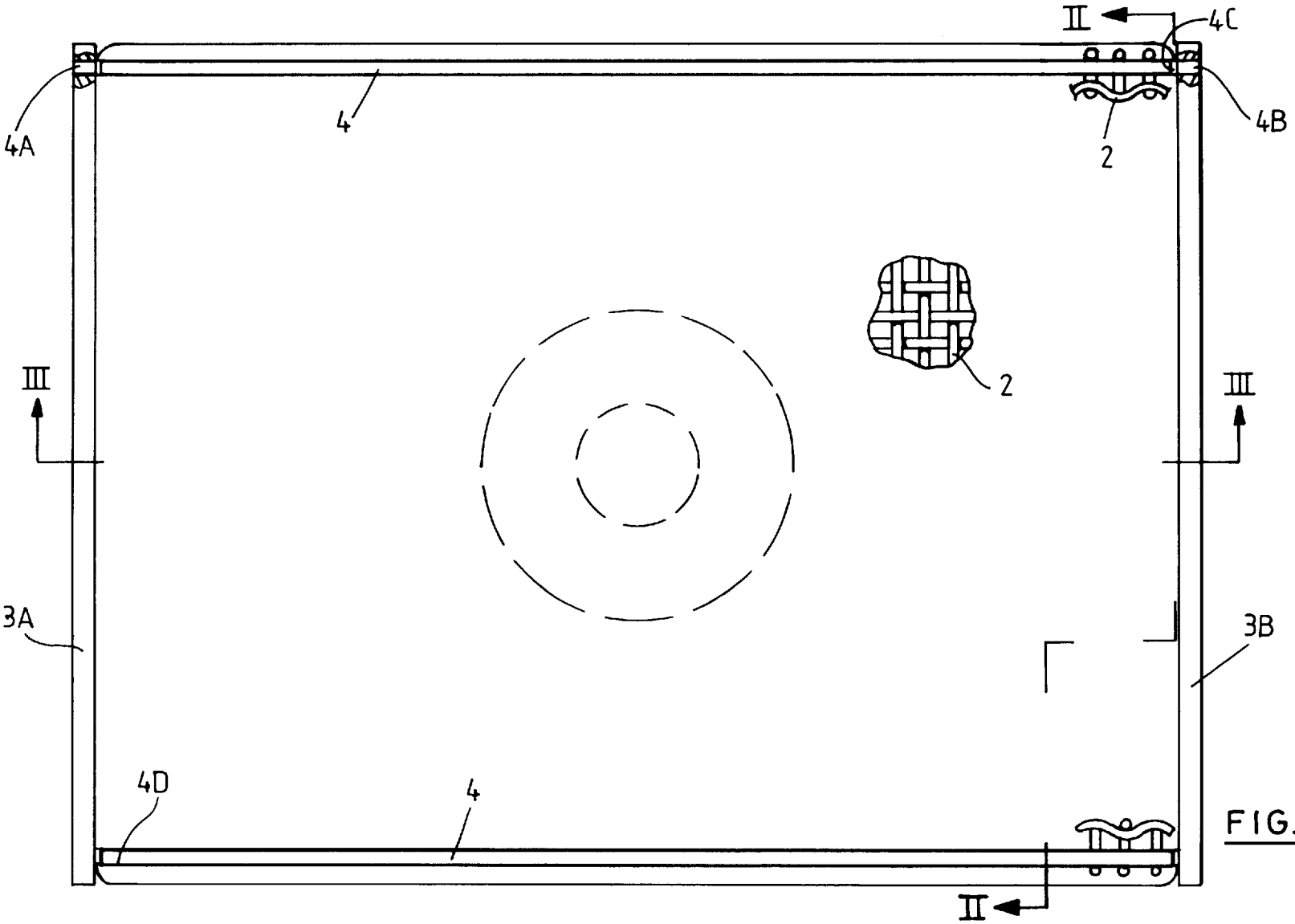
FIG. 1 is a front view of a heat emitter according to the invention.

The heat emitter or radiant represented in FIG. 1 comprises:

a back-body 8 of cast iron comprising a chamber equipped with a distributor 10 for the combustive(air, oxygen, oxygen enriched air, gas containing oxygen)/fuel(methane) mixture;

a sheet 5 made of metal fibers, for example of Békitherm fibers sintered with yttrium, the aforesaid sheet 5 resting with interposition of a ceramic or graphite joint 6 on the edges of the body 8, the aforesaid sheet having a thickness of approximately 3 mm and having a series of orifices of approximately 0.6 mm in diameter and a density of orifices of the order of 50 orifices per $cm^2$, the face of the sheet opposite to that turned toward the body 8 serving as a combustion surface for the combustive/fuel mixture;

an approximately rectangular frame 7, the side parts 7C of which bear a flat element or upper flange 7A, said frame bearing also lower arms 7B and supporting plates 7D, the flat element or upper flange 7A being destined to press the sheet 5 against the edges of the body 8, while the lateral sides 7C of the frame are distant from the lateral edges 5A of the sheet in order to leave some play or a free space to enable a certain expansion of the sheet 5;

leaf springs 9, each leaf spring having two extremities 9A respectively resting on an arm of a first lateral side of the frame and on an arm of the side opposite to the aforesaid first lateral side, the central part 9B of the leaf resting on the bottom of the body 8 so that this leaf creates a force tending to bring the flange 7A of the frame closer toward the body 8 (in other words a force to hold together or to grip the edges of the sheet 5 between the flange 7A and the edges of the body 8);

a left lug or flange 3A not attached to the frame 7, but mounted by screwing means 1 on a lateral wall 8A of the body 8;

a right lug or flange 3B not attached to the frame 7, but mounted by screwing means on the lateral wall 8B of the body opposite the lateral wall 8A of the body 8;

a screen or grating 2 made of metallic wires, the aforesaid wires being interlaced in order to form meshes with openings of approximately 3 mm×3 mm, the screen or grating having four lateral sides of which two 2A, 2B are provided with an extension 2C destined to rest on the frame 7 (on the flanges 7A of the frame 7 substantially perpendicular to the flanges or lugs 3A,3B), the aforesaid screen or grating not being attached or welded onto the aforesaid frame, and two sliding bars 4 whose extremities 4A, 4B are respectively engaged in an orifice or hole of the left lug or flange 3A and in an orifice or hole of the right lug or flange 3B, the extremity 4B being associated with a stop or abutment 4C destined to limit the movement of the small bar toward the right lug 4B, whereas the extremity 4A is associated with a finger 4D which can be moved between one position (represented in continuous line) in which the finger 4D serves as stop in order to limit the lateral movement of the small bar toward the left lug (that way preventing the withdrawal of the small bar 4), and a position in which the finger is raised (position represented in dashed-dotted lines) in order to enable a sufficient lateral movement of the small bar 4 toward the left lug in order to dislodge the extremity 4B out of its orifice and therefore in order to enable the small bar 4 to be retracted or pulled out after pivoting the bar 4 with respect to the flange.

The flanges 7A or flat parts attached to the sides 7C of the frame 7 define therebetween an opening. Each flat part or flange 7A is linked along one of its longitudinal edge to a side 7C, said flange 7A extending in a plane forming an angle Z of about 85° to 89° (preferably about 87°) with the plane in which the said side 7C extends.

The arms 7B of the frame each have an opening 7E providing passage for a part of the free extremity 9A of a leaf spring 9. This part has a transverse section below the passage section of the opening 7E. The engagement of these parts in the aforesaid openings enables the relative movements of the leaf springs in relation to the body 8 to be avoided.

Two supporting plates 7D exhibited by a side 7F of the frame serve as support for the central part of a lug adjacent to the aforesaid side.

A joint 6 extends between the face of the flange 7A of the frame turned toward the body 8 of the sheet 5. This joint 6 enables excessive wear and tear, due to the friction of the sheet 5 on the flanges 7A, to be avoided. Such a joint is for example a ceramic joint but could also be a joint made of graphite or a ceramic+mica joint or furthermore a ceramic+graphite joint or of any other material which has a lamellar or sheet structure.

Figure 7:
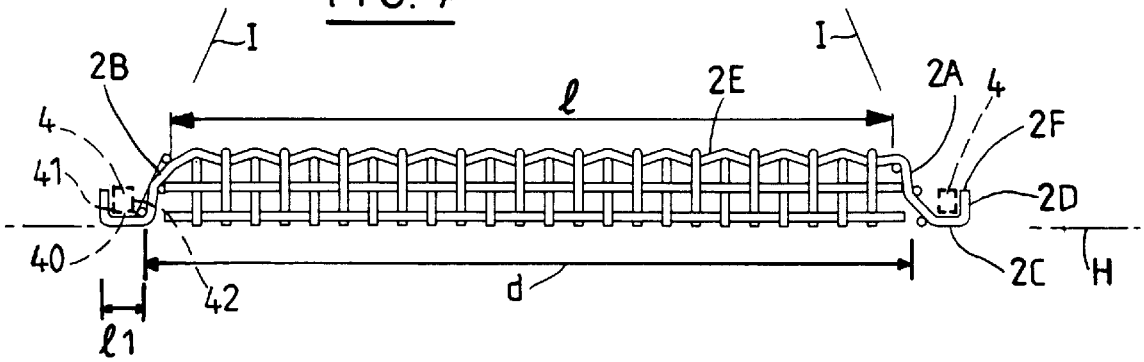
FIGS. 7 and 8 are front and side views of the screen or grating of the heat emitter shown in FIG. 1.
Figure 8:
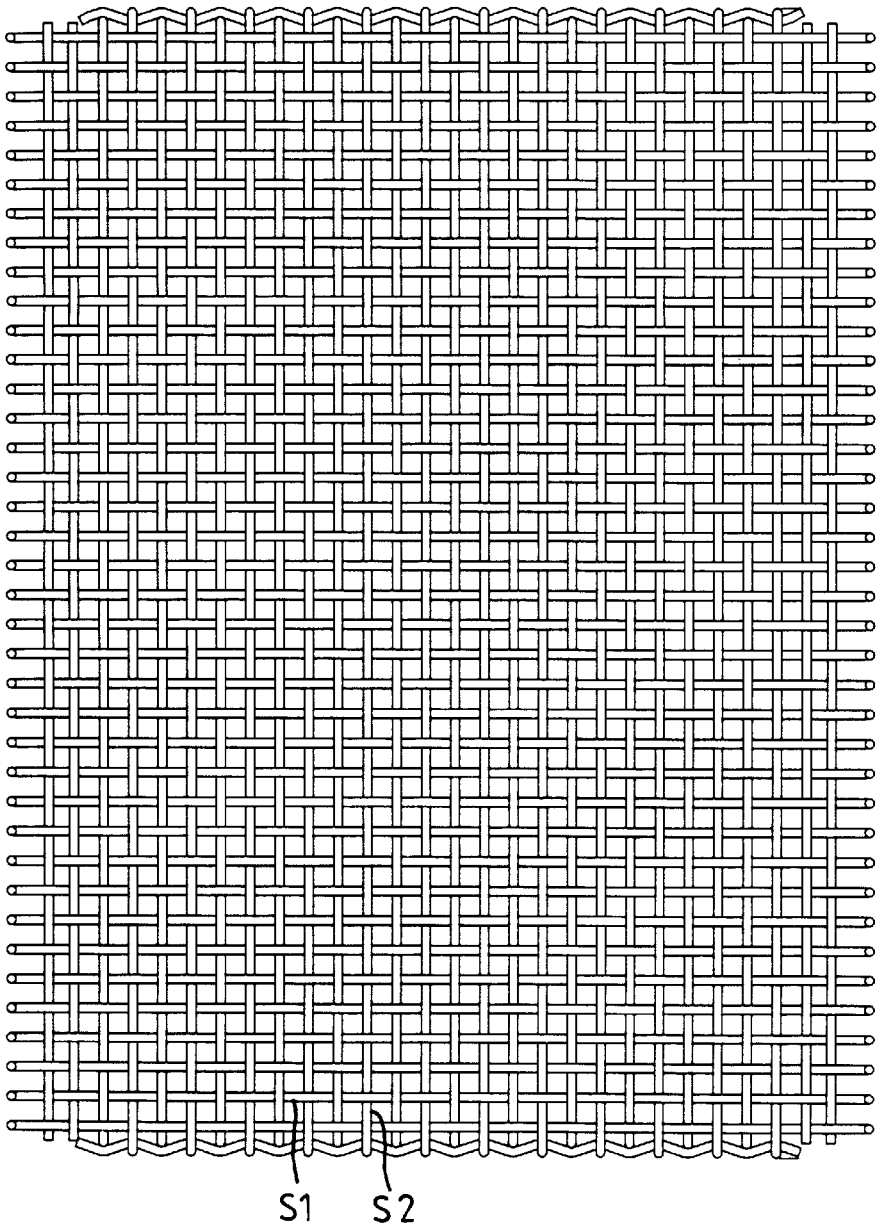

The screen or grating (see FIGS. 7 and 8) comprises a central part 2E, two lateral strips 2C each destined to be pressed by a bar 4 onto the flange 7A of the frame 7, two intermediate parts 2A, 2B each extending between the central part 2E and a lateral strip, and two extreme parts 2D each situated between a strip 2C and a free extreme edge 2F of the screen or grating. The strips 2C which are situated along two free edges opposite the grating extend approximately in a same plane H. The intermediate parts 2A, 2B each extend in a plane I inclined in relation to plane H, the angle formed between an inclined plane and the plane H being advantageously approximately 115°. The inclination of the aforesaid intermediate parts 2A, 2B is such that the distance d separating the strips 2C one from the other is greater than the width l of the central part 2E. In the embodiment represented, the screen or grating is formed by two series of metallic wires, for example in a nickel (20%) /chrome (80%) alloy, in particular in refractory steel, the aforesaid wires being interlaced in order to define approximately rectangular or square holes. The first series of wires S1 extend in a direction parallel to the short sides of the rectangular frame, whereas the second series of wires S2 extend in a direction parallel to the long sides of the rectangular frame 7. The wires of the first series therefore extend in a direction perpendicular to the direction in which the wires of the second series extend.

The wires have for example a diameter of less than 2 mm, for example of approximately 1 to 1.5 mm. The extreme parts 2D and the strips 2C are formed only by a single series of wires Si in order to ensure a better contact and a more regular contact between the aforesaid wires S1 and the small bars 4. The width 11 of the strip 2C is approximately 3 to 6 mm, and in particular approximately 4.5 mm. The openings defined by the wires of the aforesaid two series have a passage section from 6 to 15 $mm^2$, in particular of approximately 9 $mm^2$. The openings advantageously represent more than 30%, preferably more than 40% (for example from 45 to 50%) of the total surface area of the central part of the grating 2.

The said extreme parts 2D extend in a plane substantially perpendicular to the plane in which the strips 2C extend. Preferably, with respect to the strip 2C to which the part 2D is attached, the said part 2D extends in a plane forming an angle Z1 of about 87°.

The frame 7 has two opposite sides 7F each bearing two plates 7D. These opposite sides partially cover the sides of the body 8 on which the flanges or lugs 3A, 3B are mounted. The aforesaid opposite sides 7F of the frame have openings or recesses 7G, 7H in order to limit the transfer between the plates 7D and the two other opposite sides 7C of the frame 7.

The flanges or lugs 3A, 3B each have two orifices 30 each providing passage for the extremity of a small bar 4. The aforesaid orifices 30 have a passage section which has two parallel edges, in particular an approximately rectangular passage section, whereas the extremities 4A, 4B of the small bars have an approximately rectangular transverse section, so that when the aforesaid extremities are engaged in the aforesaid orifices, all rotating or torsion movement of the small bars in relation to the lugs is avoided.

The flanges or lugs 3A, 3B are mounted on the body 8 by means of two screws 1. In order to limit the transfer of heat from the aforesaid screws in contact with the body 8 toward the parts of the flanges or lugs which have the aforesaid orifices 30, the aforesaid flanges or lugs have openings or slits 31.

The aforesaid flanges or lugs are for example made of cast iron, refractory steel, preferably of refractory stainless steel. The refractory steel is advantageously a steel which contains more than 14% chrome, in particular from 18 to 30% chrome and which contains more than 12% nickel, in particular from 18 to 40% nickel.

In this embodiment, the frame 7 has an approximately rectangular form provided with one or more plates 7A which have a first face turned toward the screen or grating 2 and a second face turned toward the organ 5 which has a combustion zone, a first side 7F of the frame 7 and a second side 7F of the frame 7 opposite to each other. The aforesaid opposite sides of the aforesaid frame are the sides bearing the lugs 3A, 3B which have holes or orifices 30 in order to provide passage for the free end parts 4A, 4B of two bars 4. A first sliding bar 4 extends between a hole or orifice 3A adjacent to a first side of the frame and a hole or orifice 30 of a flange or lug adjacent to the second side of the frame, while a second small bar 4 extends between a hole or orifice 30 of a lug adjacent to the first side of the frame and a hole or orifice 30 of a flange or lug adjacent to the second side of the frame. The grating 2 has two opposite edges 2F. The first bar 4 has an approximately flat face 40 serving as a support for a first strip 2C of the screen adjacent to a first edge of this, while the second small bar 4 has an approximately flat face 40 serving as a support for a second strip 2C of the screen adjacent to a second edge of this opposite to the aforesaid first edge. The aforesaid strips 2C of the grating extend approximately in a same plane (H) and each being wedged between one of the aforesaid small bars 4 and the face of a plate or plates 7A of the frame turned towards the screen 2.

The screen 2, in addition to the aforesaid strips 2C, has a central part 2E situated between the aforesaid strips 2C and connected to the aforesaid strips by intermediate parts 2A, 2B inclined in relation to the aforesaid strips 2C, and, on the other hand, two extreme parts 2D each situated between one strip 2C and one free extremity 2F of the grating 2, the aforesaid extreme parts 2D being inclined in relation to the aforesaid strips 2C. The extreme parts 2D, the intermediate parts 2A, 2B and the strips 2C define two grooves in which the bars 4 are located when supporting the screen 2. Each of the aforesaid bars 4 has one face 41 turned towards one of the aforesaid extreme parts 2D and one face 42 turned towards an intermediate part 2A, 2B. (see FIG. 7 in which the small bars are represented in dashed-dotted lines) The bars 4 have end parts 4A, 4B having a rectangular or possibly square cross section, while the holes 30 in which said end parts are engaged have two parallel faces 30A,30B, the distance separating said parallel faces from each other corresponding substantially to the width W of the end parts 4A,4B. When the end parts 4A,4B are engaged in the holes 30 of the flanges, two parallel faces of each end part contact the two parallel faces 30A,30B of the hole, thereby preventing any rotation of the bar with respect to the longitudinal direction of the bar.

The heat emitter or radiant represented in FIGS. 1 through 4 has numerous advantages in comparison to classic radiants. These advantages are:

very limited thermal inertia, so that the adjustment of the heat emitter or radiant is almost instantaneous;

the re-entry of combustion into the internal chamber of the body is impossible owing to the size and the distribution of the orifices since there is obviously no accumulation of energy in the fibers;

the heat emitter or radiant can deliver high density power, for example from 400–500 $KW/m^2$;

a layer of aluminum oxide migrates to the surface of the sheet 5, this layer forming a protective layer for the metallic fibers against corrosion;

the screen or the grating is detachable, the removal of this does not necessitate dismantling the organ, this removable screen or grating enables organs of better quality and longer length of life to be utilized, but also enables the type of grating to be utilized to be adapted according to need or to replace the grating as soon as it has lost 50% of its qualities of absorption of heat and emission of IR rays;

an emissivity capable of reaching twice that of conventional radiants;

the stresses of expansion of the component and of the grating are taken over by independent systems;

holding the grating or screen in place is done by means of an elastic device or owing to the elasticity of the extensions of the grating or screen;

the risk of the screen or grating falling is almost nil;

the thermal deformation of the flanges or lugs between which extend the bars is limited; etc.

Figure 2:
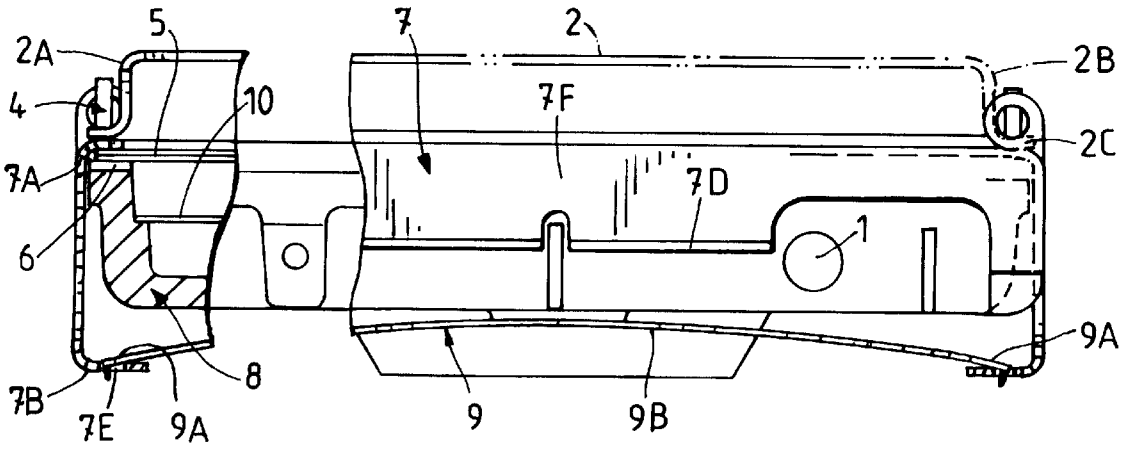
FIGS. 2 and 3 are views in partial cross-section according to the line II—II (with cut-away) and according to the line III—III of the radiant from FIG. 1.
Figure 3:
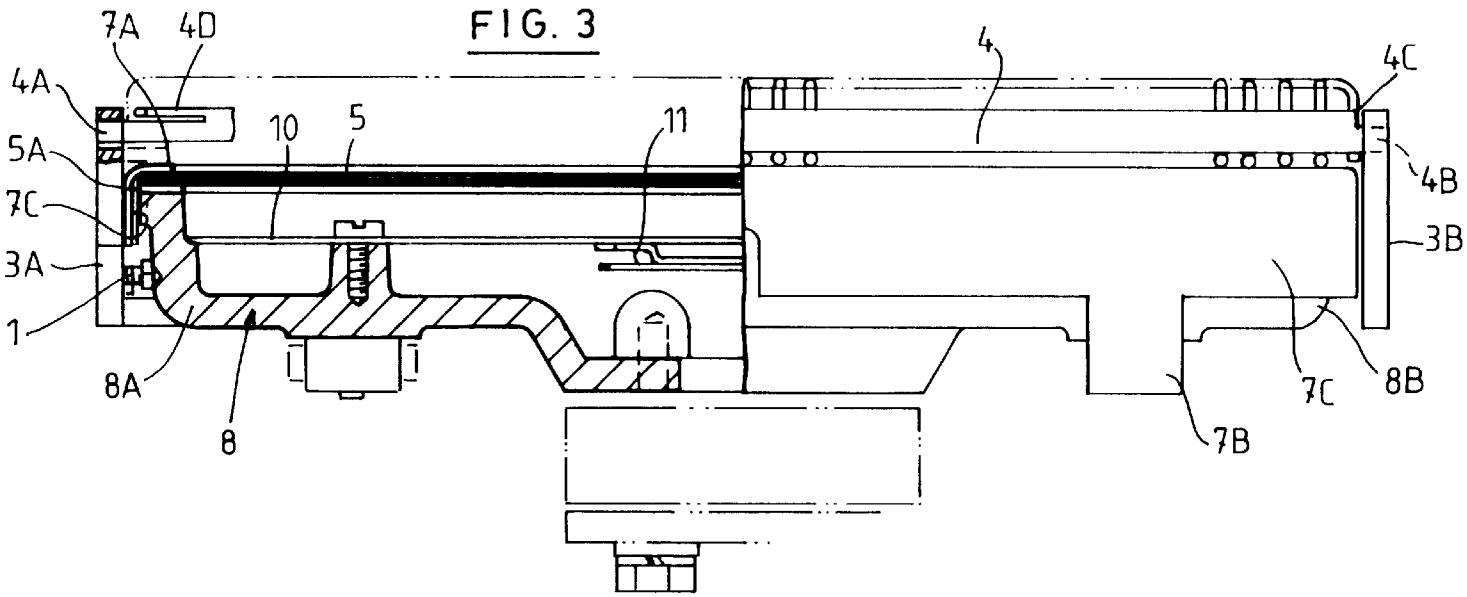
Figure 4:
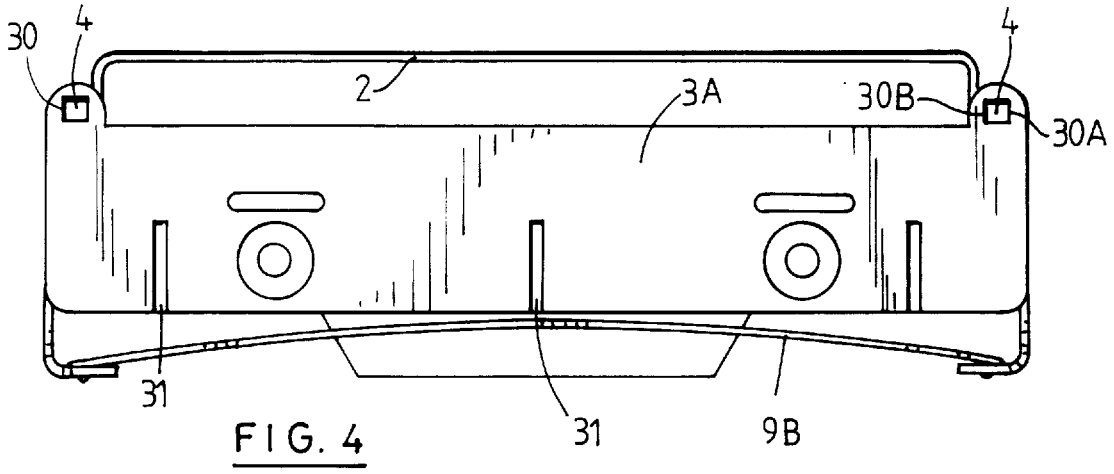
FIG. 4 is a side view of the heat emitter shown in FIG. 1.
Figure 5:
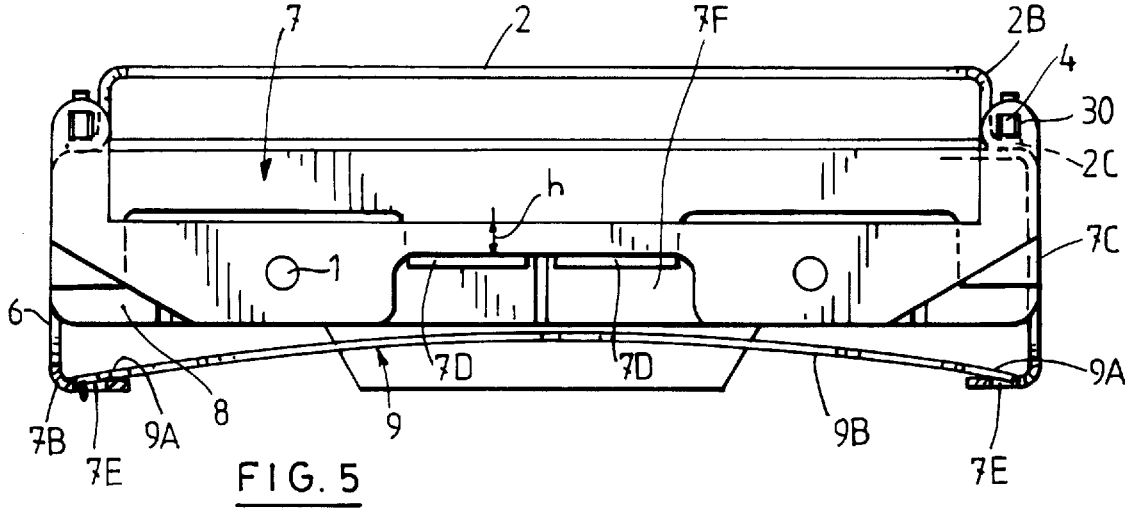
FIGS. 5 and 6 are views similar to that from FIG. 4, but for other embodiments of a heat emitter according to the invention.

FIG. 5 is a view similar to that of FIG. 2, but of another embodiment. This embodiment has two lugs 3A each consisting of a central part 32 destined to be attached to one side of the body 8 by means of two screws 1, the aforesaid central part having a zone 33 extending between the aforesaid screws, this zone having a low height h in order to limit the passage of heat between the aforesaid screws 1. This zone has a lower edge resting on the plates 7D that are on the side 7F of the frame 7. The extremities of this central part 32 bear two fingers 34 each of which has an orifice 30 destined to receive the free extremity of a small bar 4. The orifice 30 has an approximately square passage section, whereas the free extremities of the small bars engaged in an orifice have a square transverse section approximately corresponding to the passage section of the orifice.

Figure 6:
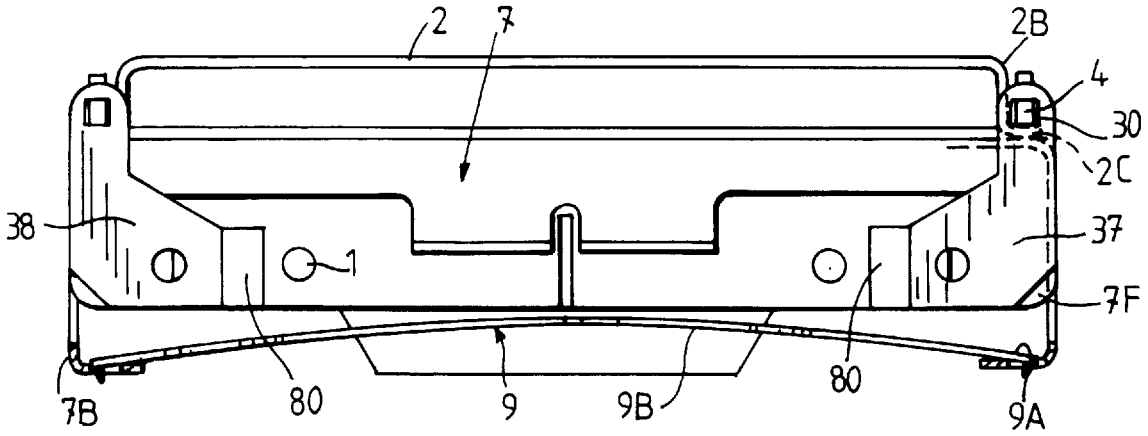

FIG. 6 is yet another side view of a radiant according to the invention. In this embodiment, the body 8 has two opposite sides 81, each of the opposite sides bearing a first lug 37 and a second lug 38 each having a hole or orifice 30 destined for providing passage for the extremity 4A, 4B of a small bar 4. A first small bar 4 extends between the first lugs 37, while the second small bar 4 extends between the second lugs 38. The body 8 has stops 80 for preventing a rotation or a pivoting of the lugs 37, 38 in relation to the body 8.

The small bars 4 could possibly be connected to each other by one or two traverses in order to form a whole. Such traverses would enable a pivoting movement of the small bars in relation to the lugs to be avoided.

What I claim is:

1. A heat emitter comprising:

(a) a back-body provided with a distributor for distributing a fuel-oxygen containing gas mixture;

(b) an organ having a combustion surface;

(c) a frame receiving at least partly said organ and connecting said back-body with said organ (5);

(d) a screen;

(e) at least a pair of flanges facing each other attached to said back-body, each flange being provided with a hole, the hole of a first flange of said pair being distant from the hole of the second flange of said pair, and (f) at least one sliding bar extending longitudinally between a first end part and a second end part opposite to said first end part, said sliding bar having a length greater than the distance separating the hole of a first flange of said pair from the hole of the second flange of said pair, said first end part and said second end part having respectively a cross section, adapted for being engaged in the hole of said first flange, and a cross section adapted for being engaged in the hole of said second flange, wherein, when said first and second end parts of the bar are engaged in the holes of said two flanges, the bar supports an edge of the screen with respect to the frame, wherein said end parts of the bar have cross sections adapted for moving longitudinally the bar from a first position in which the first end part and the second end part of the bar are respectively engaged in the hole of the first flange and in the hole of the second flange, to a second position in which the first end part is engaged in the hole of the first flange, while the second end part is not engaged in the hole of the second flange, and inversely, wherein, the first end part has a cross section adapted with respect to the hole of said first flange for pivoting the bar with respect to the first flange up to a position in which the bar is removable by pulling it out of the hole of said first flange, and wherein, at least for one flange, the shape of the hole with respect to a central axis thereof and the cross section of the end part of the bar to be engaged into said hole are adapted for limiting the rotation of the bar about said central axis.

2. The heat emitter of claim 1, in which at least for one flange, the shape of the hole with respect to its central axis and the cross section of the end part of the bar to be engaged into said hole are adapted for avoiding the rotation of the bar about said central axis.

3. The heat emitter of claim 1, in which at least for one flange, the hole is defined by a continuous edge comprising at least two different parts, at least one of said parts being straight, while the end part of the bar intended to be engaged in said hole has at least two faces, one of which is flat, whereby, when said end part of the bar is engaged in the hole, a flat face of said end part contacts a straight part of the edge of the hole while another face of said end part contacts at least partly another part of the edge of the hole.

4. The heat emitter of claim 1, in which the frame comprises a first side, a second side opposite to the first side, third and fourth sides linking said first and second sides, said sides being provided with a substantially flat element having a first face directed towards said organ at least partly engaged in the frame and a second face opposite to said first face and directed towards the screen in which said first and second sides are adjacent respectively to a first flange and a second flange borne by the back-body, said first and second flanges facing each other and having two holes receiving the end part of two sliding bars, whereby a first sliding bar extends between a first hole of the first flange and a first hole of the second flange so as to support a first edge band of the screen, while the second sliding bar extends between the second hole of the first flange and the second hole of the second flange so as to support a second edge band of the screen opposite to said first edge band in which the end parts of the first and second bars have cross sections adapted with respect to the holes of the flanges for moving longitudinally each of said bars from a first position in which the first end part and the second part of the bar are respectively engaged in the hole of the first flange and in the hole of the second flange, to a second position in which the first end part is engaged in the hole of the first flange, while the second end part is not engaged in the hole of the second flange, and inversely, in which the first end part of the first and second bars has a cross section adapted, with respect to the hole of a flange in which said end part is engaged, for pivoting the bar with respect to the flange up to a position in which the bar is removable by pulling it out of the hole of said first flange, in which the second end part of the first and second bars has a cross section adapted, with respect to the hole of a flange in which said second end part is engaged, for avoiding the rotation of the bar about its central axis.

5. The heat emitter of claim 4, in which the screen comprises a central part linked by intermediary parts to the edge bands, said edge bands extending in a plane which is parallel to the plane in which the central part extends.

6. The heat emitter of claim 4, in which the screen comprises a central part linked by intermediary parts to the edge bands, said edge bands extending in a plane which is parallel to the plane in which the central part extends, in which each intermediary part extends in a plane inclined with respect to the plane in which extends the central part, and in which each edge band is provided with an end part inclined with respect to the plane in which the edge band extends so as to define with an intermediary part a groove in which a bar extends.

7. The heat emitter of claim 4, in which the screen comprises a central part linked by intermediary parts to the edge bands, said edge bands extending in a plane which is parallel to the plane in which the central part extends, in which each intermediary part extends in a plane inclined with respect to the plane in which extends the central part, and in which each edge band is provided with an end part inclined with respect to the plane in which the edge band extends so as to define with an intermediary part a groove in which a bar extends, in which each bar has a first planar face for contacting an edge band of the screen, a second planar face directed towards an intermediary part and a third planar face directed towards an end part.

8. The heat emitter of claim 4, in which the screen comprises a central part linked by intermediary parts to the edge bands, said edge bands extending in a plane which is parallel to the plane in which the central part extends, in which each intermediary part extends in a plane forming an angle from 110° to 120° with respect to the plane in which extends the central part, and in which each edge band is provided with an end part forming an angle from 80° to 120° with respect to the plane in which extends the edge band, so as to define with an intermediary part a groove in which a bar extends.

9. The heat emitter of claim 4, in which each flange consists of two distinct pieces each having a hole, and in which the back-body is provided with abutments for avoiding any pivoting of said pieces when attached to the back-body.

10. The heat emitter of claim 4, in which each flange consists of a piece comprising a central plate bearing at one end a first ear with a hole and at another end a second ear with a hole, said central plate having, between its ends, at least one part with a cross section smaller than the cross section of the plate near its ends.

11. The heat emitter of claim 1, in which the flanges are made of refractory steel.

12. The heat emitter of claim 1, in which the flanges are made of refractory steel selected from the group consisting of refractory steel containing more than 14% Cr, refractory steel containing more than 12% Ni, refractory steel containing more than 14% Cr and more than 12% Ni.

* * * * *